US005505183A

United States Patent [19]

Sinha et al.

[11] Patent Number: 5,505,183

[45] Date of Patent: Apr. 9, 1996

[54] METHOD AND SYSTEM FOR CONTROLLING EMISSIONS FROM AN INTERNAL COMBUSTION ENGINE

[75] Inventors: Satyadeo N. Sinha, Canton; Raymond H. Berger, Dearborn, both of Mich.

[73] Assignee: Ford Motor Company, Dearborn, Mich.

[21] Appl. No.: 402,429

[22] Filed: Mar. 10, 1995

[51] Int. Cl.[6] ..... F02D 41/14; F02D 41/22

[52] U.S. Cl. ..... 123/688; 73/118.1; 123/697

[58] Field of Search ..... 123/479, 688, 123/690, 697; 73/23.32, 118.1; 204/401

[56] References Cited

U.S. PATENT DOCUMENTS

| | | | |
|---|---|---|---|
| 4,938,194 | 7/1990 | Kato et al. | 123/688 |
| 5,036,820 | 8/1991 | Fujimoto et al. | 123/688 X |
| 5,054,452 | 10/1991 | Denz | 123/688 X |
| 5,090,387 | 2/1992 | Mayer et al. | 123/688 X |
| 5,228,426 | 7/1993 | Pursifull et al. | 123/697 X |
| 5,235,957 | 8/1993 | Furuys | 123/688 |
| 5,245,979 | 9/1993 | Pursifull et al. | 123/697 X |

*Primary Examiner*—Tony M. Argenbright
*Attorney, Agent, or Firm*—Peter Abolins; Roger L. May

[57] ABSTRACT

A method and system for reducing emissions from an engine during periods of partial or total heated exhaust gas oxygen (HEGO) sensor failure. A switch point is stored in an electronic engine control for use in controlling the fuel delivered to the engine based on the value of the signal generated by the oxygen sensor relative to the switch point. The method includes the step of sensing the current of the heater element of the HEGO sensor. The sensed current is compared to a first predetermined current threshold which indicates a degradation of the HEGO sensor. A degradation of the HEGO sensor introduces a bias signal to the electronic engine control. If the current of the heater element is below the first predetermined current threshold but not below a second predetermined current threshold, the switch point is changed so as to compensate for degradation of the oxygen sensor. The electronic engine control then controls the delivery of fuel to the engine based on the value of the signal generated by the oxygen sensor relative to the changed switch point until the HEGO sensor is replaced.

9 Claims, 4 Drawing Sheets

METHOD AND SYSTEM FOR CONTROLLING EMISSIONS FROM AN INTERNAL COMBUSTION ENGINE

TECHNICAL FIELD

This invention relates to emission control, and in particular, to emission control during periods of partial and total Heated Exhaust Gas Oxygen (HEGO) sensor heater failure.

BACKGROUND ART

The passage by Congress of laws to reduce emissions of certain gases from automobiles led to the introduction by the automobile manufacturers of various control systems. These control systems minimize exhaust emissions and fuel consumption, provide optimal driveability for all operating conditions, minimize evaporative emissions, and provide system diagnosis when malfunctions occur.

Control systems developed by automobile manufacturers include the Positive Crankcase Ventilation (PCV) system, Exhaust Gas Recirculation (EGR) system, and fuel evaporation emission control system. These are effective in blocking the escape of emissions from such areas as the carburetor, fuel tank, and crankcase of automotive vehicles.

Another system was needed to reduce emissions of hydrocarbon (HC) and carbon monoxide (CO). These compounds are generated as fuel is burned in an engine's cylinders and are released into the atmosphere with the exhaust. The catalytic converter was developed to neutralize these compounds. Catalytic converters have been installed on practically every vehicle having a gasoline engine that has been manufactured since 1975.

To further meet emissions standards imposed by Congress, automobile manufacturers have developed an exhaust gas oxygen sensor which is positioned in the path of the exhaust gases. The exhaust gas oxygen sensor provides a feedback signal of the oxygen content of the exhaust gases from which it can be determined if the air/fuel mixture being supplied to the engine is rich or lean. This feedback signal is transmitted to a fuel control system in the automobile wherein a fuel control signal is switched around stoichiometric air/fuel ratio. The fuel control signal is used to control the fuel mixture delivered to the engine, thereby controlling the amount of emission constituents exiting from the automobile's tailpipe to a minimum. The stoichiometric air/fuel mixture is approximately 14.7 parts air and one part gasoline.

The exhaust gas oxygen sensor needs to operate at a temperature over 670° F. to provide an accurate signal. In an effort to reduce the time required to achieve operating temperature, a resistive element heater has been added to the sensor. However, as the sensor ages, the heater's effectiveness degrades. In addition, the heater is always susceptible to electrical system problems, such as, open circuits, poor connections, harness connector corrosion, etc.

When the Heated Exhaust Gas Oxygen (HEGO) sensor degrades or fails, a lean or rich bias signal, depending on the type of HEGO sensor utilized, is imposed onto the feedback signal generated by the HEGO. In the case where the HEGO sensor utilized imposes a rich bias onto the feedback signal when the sensor degrades or fails, the fuel control system reduces the amount of fuel being delivered to the engine resulting in a leaner air/fuel mixture which causes more production of $NO_x$ during combustion with minimum impact on the production of CO and HC. Thus, the engine may not meet the government-imposed emissions standards. Conversely, if the HEGO sensor utilized imposes a lean bias when the sensor fails, the fuel control system increases the amount of fuel delivered to the engine resulting in a richer air/fuel mixture that causes more production of CO in the exhaust gas.

DISCLOSURE OF THE INVENTION

It is thus a general object of the present invention to provide a method and system for detecting a HEGO sensor degradation and controlling fuel delivery to an engine in response thereto.

It is another object of the present invention to provide a method and system for reducing emissions from an internal combustion engine during periods of partial and/or total HEGO heater failure.

In carrying out the above objects and other objects, features and advantages, of the present invention, a method is provided for detecting a HEGO sensor degradation and reducing emissions from the engine. The method includes the initial step of sensing a current of the heater element of the HEGO to generate a current signal. The method also includes the step of determining if the current of the heater element is below a first predetermined current threshold based on the value of the current signal. The first predetermined current threshold represents a heater failure whereby a rich or lean bias is introduced into the fuel control system. Finally, the method concludes with the step of changing a calibratable switch point to compensate for the bias in the fuel if the current of the heater element is below the first predetermined current threshold. The calibratable switch point is a parameter used by the electronic engine control to indicate whether the air/fuel mixture being supplied to the engine by the fuel delivery system is either lean or rich.

Preferably, the method further includes the steps of determining whether the current of the heater element is below a second predetermined current threshold based on the value of the current signal and generating a malfunction signal if the current of the heater element is below the second predetermined current threshold.

In further carrying out the above objects and other objects, features and advantages, of the present invention, a system is also provided for carrying out the steps of the above described method.

The system includes a sensor for sensing the current of the heater element of the HEGO to generate a current signal. The system further includes a control unit, coupled to the sensor, for determining if the current of the heater element is below the first predetermined current threshold based on the current signal and for changing the switch point to compensate for a bias in the fuel delivery system if the current of the heater element is below the first predetermined current threshold.

The above objects, features and advantages of the present invention, as well as others, are readily apparent from the following detailed description of the best mode for carrying out the invention when taken in connection with the accompanying drawings.

BEST MODES FOR CARRYING OUT THE INVENTION

Figure 1:
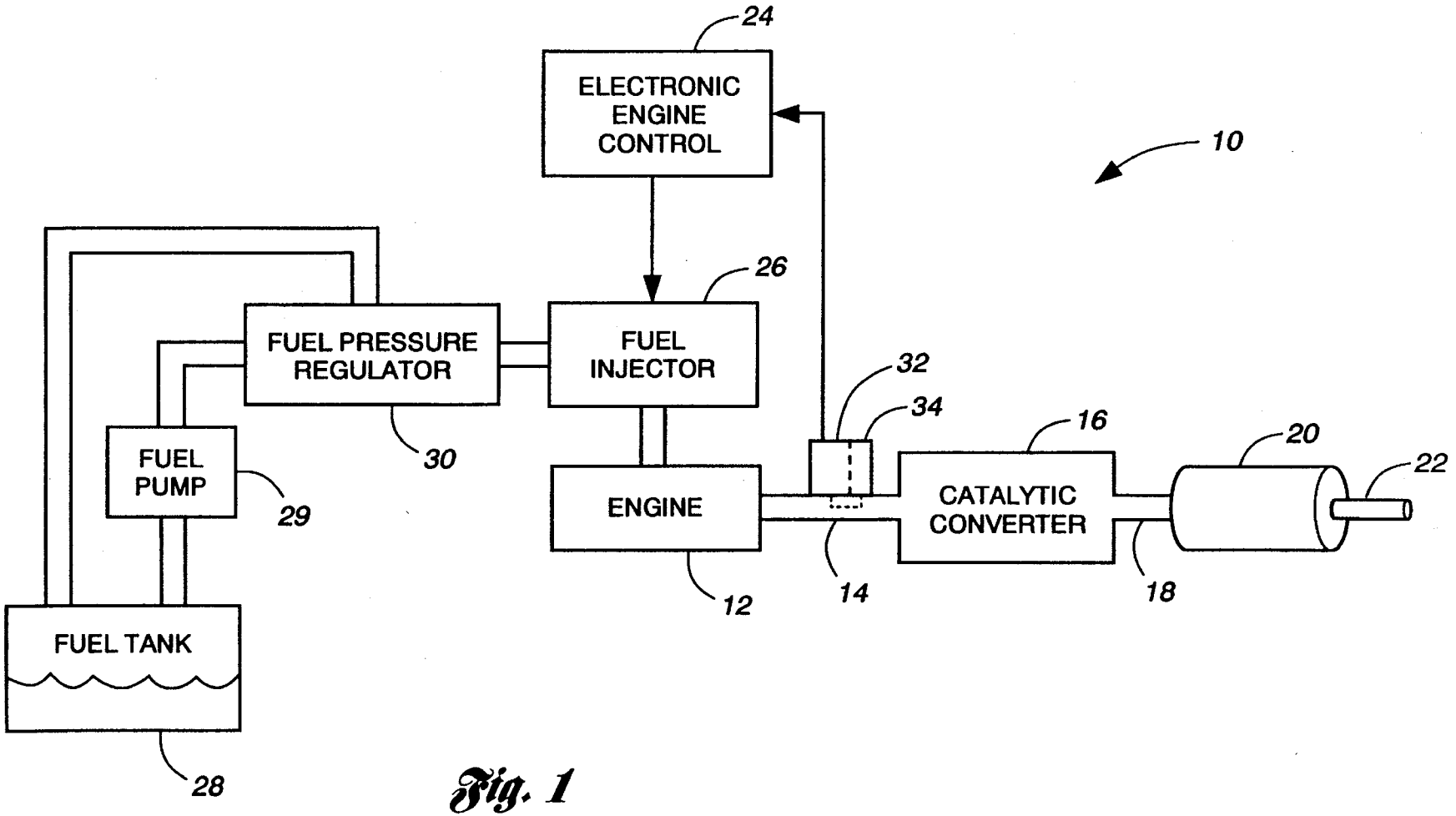
FIG. 1 is a block diagram of the preferred embodiment of the present invention.

Referring now to FIG. 1, a block diagram of the system of the present invention is shown, denoted generally by reference numeral 10. The system 10 includes an internal combustion engine 12 having an exhaust manifold 14 and a catalytic converter 16.

As the engine 12 burns the fuel mixture, the burnt air/fuel mixture is exhausted from the engine 12 into the exhaust manifold 14. From the exhaust manifold 14, the exhaust gases flow into the catalytic converter 16. In the catalytic converter 16, the catalysts—usually platinum and palladium—convert HC and CO into water vapor and carbon dioxide, respectively. Extreme heat is needed to make this conversion, but extreme heat reacts adversely with nitrogen in the exhaust gases. The result is the generation of the toxic element, $NO_x$, which is a contributor to atmospheric smog.

The partially treated gases are then cooled by air from an air pump (not shown) connected to and driven by the engine 12. Next, a third catalytic agent—usually rhodium—transforms $NO_x$ back into harmless nitrogen. The three agents—water vapor, carbon dioxide, and nitrogen—are then expelled through a rear exhaust pipe 18, muffler 20, and tailpipe 22.

The system 10 also includes an Electronic Engine Control (EEC) 24. The EEC 24 functions to maintain the proper mixture of fuel and air needed for the car's driving conditions.

Coupled to the EEC 24 is a fuel injector 26 which injects fuel into the engine 12 based on signals from the EEC 24. The system 10 of the present invention illustrates the use of a single fuel injector 26 to deliver fuel to the engine 12. However, the system may comprise a plurality of fuel injectors 26 for injecting fuel into each cylinder in the engine 12.

The system 10 further includes a fuel tank 28 from which fuel is supplied to the fuel injector 26 via a fuel pump 29. The system 10 also includes a pressure regulator 30 to control the pressure of the fuel being delivered to the fuel injector 26. Excess fuel not delivered by the fuel injector 26 into the engine 12 is returned to the fuel tank 28 from the fuel pressure regulator 30.

Finally, the system includes a Heated Exhaust Gas Oxygen (HEGO) sensor 32 having a resistive element heater 34 to reduce the time required to achieve optimum operating temperature. The HEGO sensor 32 senses the exhaust gases in the exhaust manifold 14 and generates a feedback signal to the EEC 24.

A calibratable switch point parameter stored in the EEC 24 is associated with the HEGO sensor 32 to allow the EEC 24 to interpret the oxygen content of the fuel mixture. FIG. 2A is a graph illustrating an output signal provided by the HEGO sensor 32. A voltage level designated as the switch point, e.g., 0.45 V, is stored in the EEC 24 for controlling the fuel mixture delivered to the engine. For example, if the feedback signal from the HEGO sensor 32 is above the switch point, indicating unburned fuel in the exhaust gas, the fuel mixture provided to the engine 12 is rich. Conversely, if the feedback signal from the HEGO sensor 32 is below the switch point, indicating excessive oxygen in the exhaust gases, the fuel mixture is lean. In response to the feedback signal from the HEGO sensor 32, the EEC 24 controls the fuel injector 26 to provide either less or more fuel, respectively, to the engine 12.

Figure 3A:
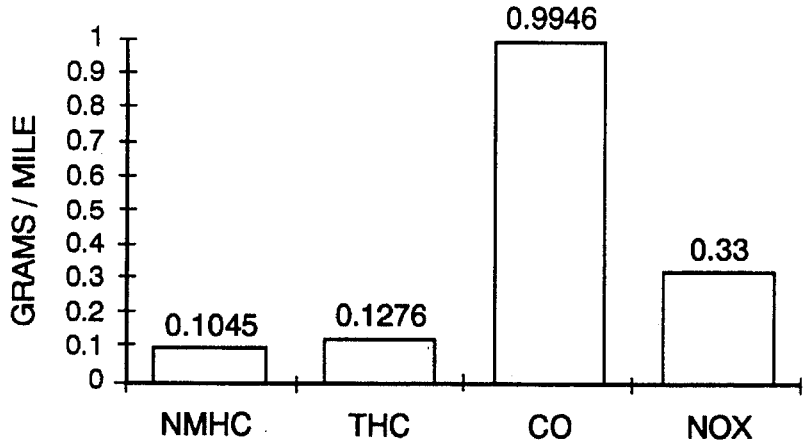
FIGS. 3A–3C are graphs illustrating amounts of various compounds emitted during HEGO heater operation and failure.
Figure 3B:
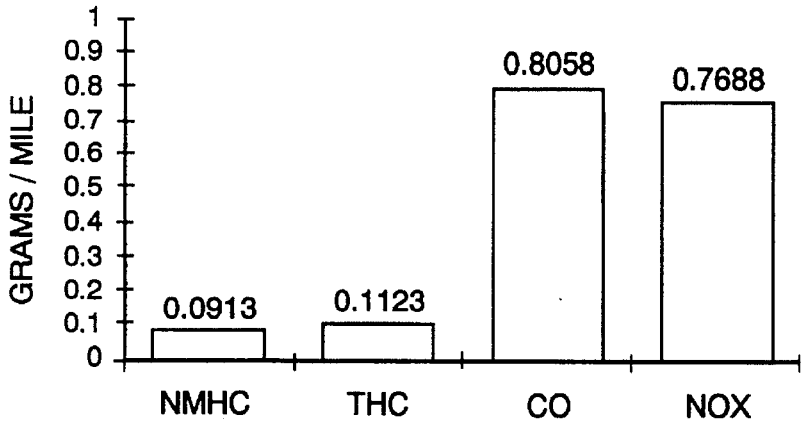
Figure 3C:
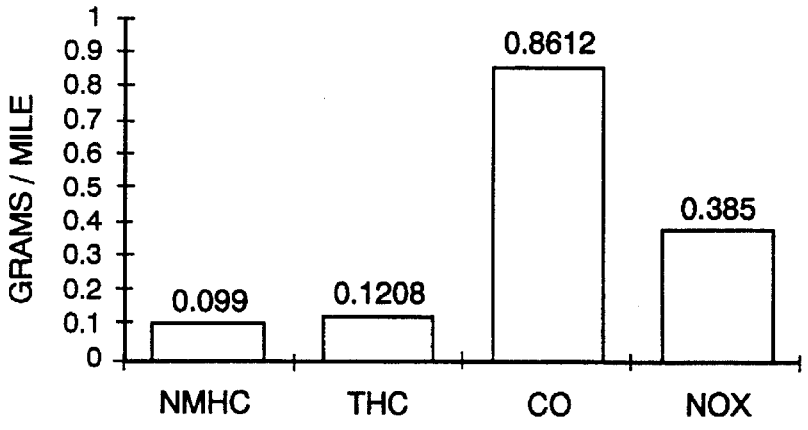

As shown in FIGS. 3A–3C, there is an inverse relationship between the current through the HEGO heater 34 and the vehicle's $NO_x$ emissions. FIG. 3A illustrates that when the current through the HEGO heater 34 is at its relative maximum indicating the heater is working properly, the $NO_x$ emissions are at their relative minimum. Only 0.33 grams/mile of $NO_x$ are emitted when the HEGO heater 34 is operating properly.

However, when the HEGO heater 34 current is zero, as shown in FIG. 3B, the $NO_x$ emissions are maximized, having a value of approximately 0.7688 grams/mile, and exceed the emission standards for that particular engine, generally 0.37 grams/mile. Hydrocarbon (NMHC and HC) and carbon monoxide (CO) emissions are virtually unaffected by the value of the HEGO heater 34 current. The output of the HEGO sensor is shifted upward from the switch point as illustrated in FIG. 2B. Consequently, a failure of the HEGO heater 34 imposes a bias onto the fuel control system.

Figure 2C:
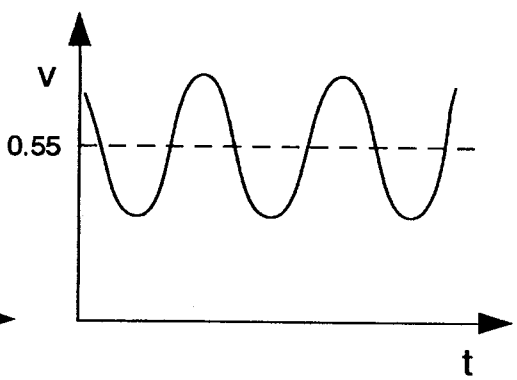
FIGS. 2A–2C are graphs illustrating the voltage output of a HEGO sensor versus time.
Figure 2B:
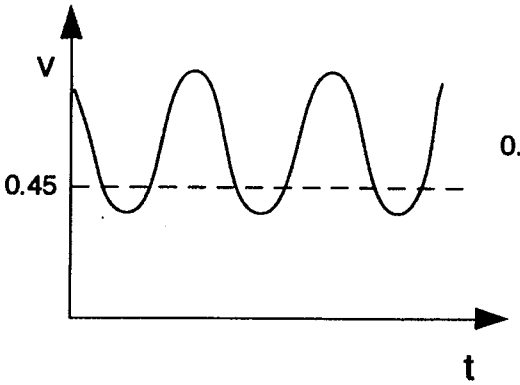
Figure 2A:
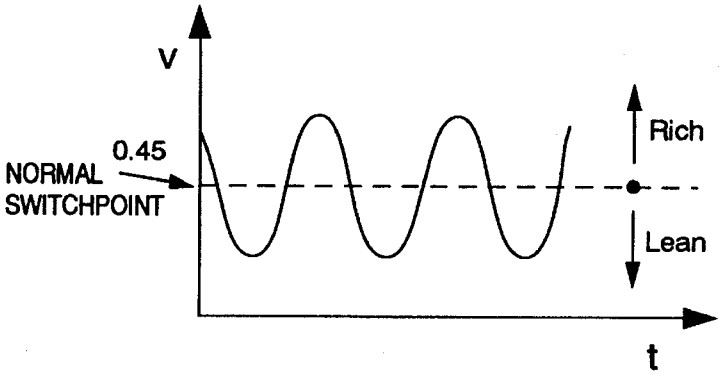

Referring now to FIGS. 2C and 3C, when the switch point is changed, for example, increased to 0.55 V, the $NO_x$ emissions were significantly lower with virtually no change in NMCH, HC or CO. A further increase in the switch point, e.g., 0.56 or 0.57 V, results in a further decrease of the production of $NO_x$ whereby emission standards are maintained.

Figure 4:
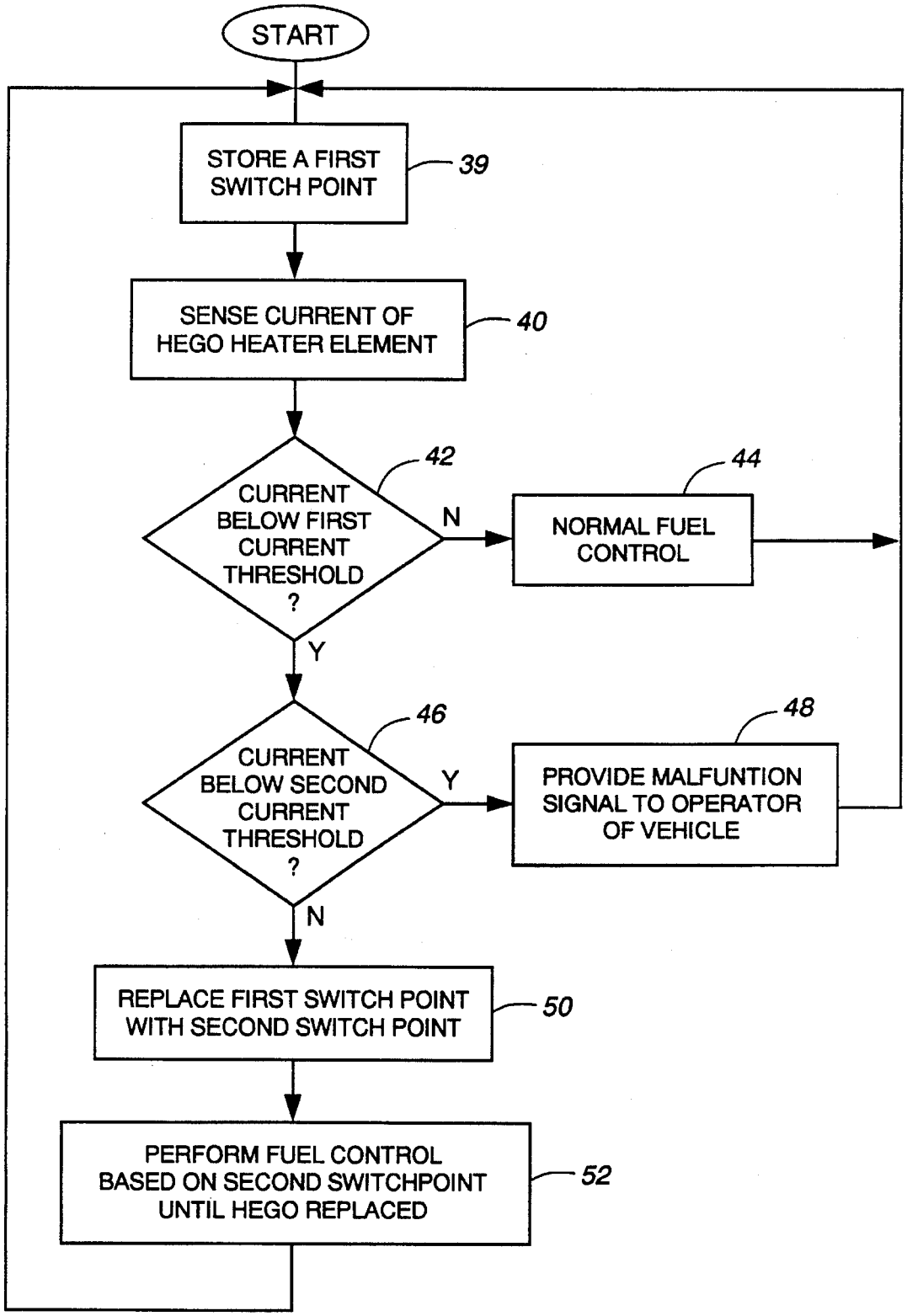
FIG. 4 is a flow diagram illustrating the general sequence of steps associated with the operation of the present invention.

Referring now to FIG. 4, there is shown a flow diagram illustrating the general sequence of steps associated with the operation of the present invention. The method begins with the step of storing a first switch point for use in interpreting the oxygen content of the fuel mixture, i.e., rich or lean, as shown by block 39. The method continues with the step of sensing the current of the HEGO heater element as shown by block 40.

Next, the method continues with the step of determining whether the current is below a first predetermined current threshold, as shown by conditional block 42. The first predetermined current threshold is a threshold experimentally determined to represent a degradation in the HEGO heater 34 sufficient to affect the exhaust emissions from the engine.

If the current of the HEGO heater 34 exceeds the first predetermined current threshold, the EEC 24 performs normal fuel control, as shown by block The EEC utilizes the original switch point associated with the HEGO sensor 32 in determining the required amount of gasoline to maintain an appropriate air/fuel ratio.

If the current of the HEGO heater 34 is below the first predetermined current threshold, the method proceeds to determine if the current of the HEGO heater 34 is below a second predetermined current threshold, as shown by decision block 46. The second predetermined current threshold is a threshold experimentally determined to indicate a failure of the HEGO heater 34, such as zero.

If the current of the HEGO heater 34 is below the second predetermined current threshold, the method generates a malfunction signal to an operator of the vehicle, as shown by block 48. The malfunction signal may be either a visual signal, such as a continuous or flashing light-emitting diode, or an audio signal or both.

If, however, the current is not below the second predetermined current threshold, the method continues with the step of replacing the first switch point with a second switch point, as indicated at block 50. The new second switch point is determined based on the heater current measured during current monitoring. That is, the switch point is modified toward rich or lean so as to offset, respectively, the lean or rich bias introduced by the degraded HEGO heater 34.

The EEC 24 then performs fuel control based on the value of the signal generated by the HEGO sensor using the new second switch point, as shown by block 52. The EEC 24 performs fuel control based on the second switch point until the HEGO sensor 32 is replaced by a new HEGO sensor. When the failed HEGO sensor 32 is replaced with a new HEGO sensor, the EEC 24 performs fuel control based on the original first switch point.

The changeover to the second switch point could be either a step change or a gradual change depending on the amount of change actually required.

While the best modes for carrying out the invention have been described in detail, those familiar with the art to which this invention relates will recognize various alternative designs and embodiments for practicing the invention as defined by the following claims.

What is claimed is:

1. For use with a vehicle having an engine, at least one fuel injector for injecting fuel into the engine, a Heated Exhaust Gas Oxygen (HEGO) sensor having a heater element for generating an oxygen level signal representative of the oxygen content in the fuel mixture, and a control unit for controlling the quantity of fuel delivered by the fuel injector to the engine in response to the value of the oxygen level signal, a method for reducing emissions from the engine comprising:

storing a first switch point for use in interpreting the oxygen content of the fuel mixture;

sensing a current of the heater element of the HEGO sensor to generate a current signal;

determining whether the current of the heater element is below a first predetermined current threshold based on the value of the current signal;

if the current of the heater element is below the first predetermined current threshold, replacing the first switch point with a second switch point; and controlling the quantity of fuel delivered to the engine by the fuel injector using the second switch point.

2. The method of claim 1 wherein the second switch point is greater than the first switch point.

3. The method of claim 1 wherein the second switch point is less than the first switch point.

4. The method of claim 1 wherein the step of replacing the first switch point is performed instantaneously.

5. The method of claim 1 wherein the step of replacing the first switch point is performed gradually.

6. The method of claim 1 further comprising:

determining whether the current of the heater element is below a second predetermined current threshold based on the current signal; and generating a malfunction signal if the current of the heater element is below the second predetermined current threshold.

7. The method of claim 6 wherein the step of generating a malfunction signal includes generating an audio signal.

8. The method of claim 6 wherein the step of generating a malfunction signal includes generating a visual signal.

9. For use with a vehicle having an engine, at least one fuel injector for injecting fuel into the engine, a Heated Exhaust Gas Oxygen (HEGO) sensor having a heater element for generating an oxygen level signal representative of the oxygen content in the fuel mixture, and a control unit for controlling the quantity of delivered fuel by the fuel injector to the engine in response to the value of the oxygen level signal, a system for reducing emissions from the engine comprising:

a sensor for sensing a current of the heater element of the HEGO sensor to generate a current signal; and the control unit coupled to the sensor for:

storing a first switch point for use in interpreting the oxygen content of the fuel mixture;

determining whether the current of the heater element is below a first predetermined current threshold based on the value of the current signal;

if the current of the heater element is below the first predetermined current threshold, replacing the first switch point with a second switch point; and controlling the quantity of fuel delivered to the engine by the fuel injector using the second switch point.

* * * * *